US007722209B2

(12) United States Patent
Matthews et al.

(10) Patent No.: US 7,722,209 B2
(45) **Date of Patent: *May 25, 2010**

(54) FLASHLIGHT WITH SELECTABLE OUTPUT LEVEL SWITCHING

(75) Inventors: John W. Matthews, Newport Beach, CA (US); Paul Y. Kim, Irvine, CA (US); William A. Hunt, Foothill Ranch, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/786,625

(22) Filed: Apr. 11, 2007

(65) Prior Publication Data

US 2007/0195522 A1 Aug. 23, 2007

Related U.S. Application Data

(63) Continuation of application No. 10/732,883, filed on Dec. 9, 2003, now Pat. No. 7,220,016.

(51) Int. Cl.
*F21L 4/04* (2006.01)

(52) U.S. Cl. ..... 362/205; 362/206; 362/295; 362/802

(58) Field of Classification Search ..... 362/205–206, 362/295, 802
See application file for complete search history.

(56) References Cited

U.S. PATENT DOCUMENTS

| | | | |
|---|---|---|---|
| 1,214,583 | A | 2/1917 | Persons |
| 4,388,673 | A | 6/1983 | Maglica |
| 4,499,525 | A | 2/1985 | Mallory |
| 4,527,223 | A | 7/1985 | Maglica |
| 4,581,686 | A | 4/1986 | Nelson |
| 4,677,533 | A | 6/1987 | McDermott et al. |
| 4,760,504 | A | 7/1988 | Schaller et al. |
| 4,782,432 | A | 11/1988 | Coffman |
| 4,876,416 | A | 10/1989 | Frantz et al. |
| 4,947,291 | A | 8/1990 | McDermott |
| 5,161,879 | A | 11/1992 | McDermott |
| 5,418,433 | A | 5/1995 | Nilssen |
| 5,498,934 | A | 3/1996 | Nilssen |
| 5,629,105 | A | 5/1997 | Matthews |
| 5,642,932 | A | 7/1997 | Matthews |
| 5,685,637 | A | 11/1997 | Chapman et al. |
| 5,722,755 | A | 3/1998 | Slape |
| 5,790,013 | A | 8/1998 | Hauck |
| 5,821,697 | A | 10/1998 | Weber |
| 6,019,482 | A | 2/2000 | Everett |
| 6,024,471 | A | 2/2000 | McDermott |

(Continued)

*Primary Examiner*—Jason Moon Han
(74) *Attorney, Agent, or Firm*—Haynes and Boone, LLP

(57) ABSTRACT

A flashlight has a lamp, a power source, two switches, and a controller connected to the switches. The first switch controls delivery of power to the lamp, and the second switch selects a dimmed brightness level. The first switch may invoke the dimmed level, or a maximum brightness level. The second switch may be a ring rotatable about the axis the flashlight, and either rotatable through a wide range of positions, with sensor circuitry to detect the absolute position, or having a limited range of rotation, with dimmed level selection provided by a duration of momentary rotation in either direction. The second switch may be positioned outside a leak resistant housing, and may include a magnet detectable by magnetic field sensors within the chamber.

10 Claims, 5 Drawing Sheets

U.S. PATENT DOCUMENTS

| | | | |
|---|---|---|---|
| 6,046,572 | A | 4/2000 | Matthews et al. |
| 6,079,847 | A | 6/2000 | Nelson |
| 6,095,661 | A | 8/2000 | Lebens et al. |
| 6,183,105 | B1 | 2/2001 | Parker |
| 6,249,089 | B1 | 6/2001 | Bruwer |
| 6,296,367 | B1 | 10/2001 | Parsons et al. |
| 6,305,818 | B1 | 10/2001 | Lebens et al. |
| 6,307,328 | B1 | 10/2001 | Ko et al. |
| 6,386,730 | B1 | 5/2002 | Matthews |
| 6,402,339 | B1 | 6/2002 | Mukogawa et al. |
| 6,616,296 | B1 | 9/2003 | Roux et al. |
| 6,793,366 | B2 | 9/2004 | Chun |
| 6,841,941 | B2 | 1/2005 | Kim et al. |
| 7,186,002 | B2 | 3/2007 | Matthews et al. |
| 7,220,016 | B2 | 5/2007 | Matthews et al. |
| 7,293,893 | B2 | 11/2007 | Kim |
| 7,344,270 | B2 | 3/2008 | Kim |
| 7,527,388 | B2 | 5/2009 | Kim |
| 7,540,625 | B2 | 6/2009 | Matthews et al. |
| 2004/0008510 | A1 | 1/2004 | Mah |
| 2004/0190286 | A1* | 9/2004 | Chapman ..... 362/171 |
| 2005/0237737 | A1 | 10/2005 | Kim |
| 2007/0247839 | A1 | 10/2007 | Kim |

* cited by examiner

FIG. 1
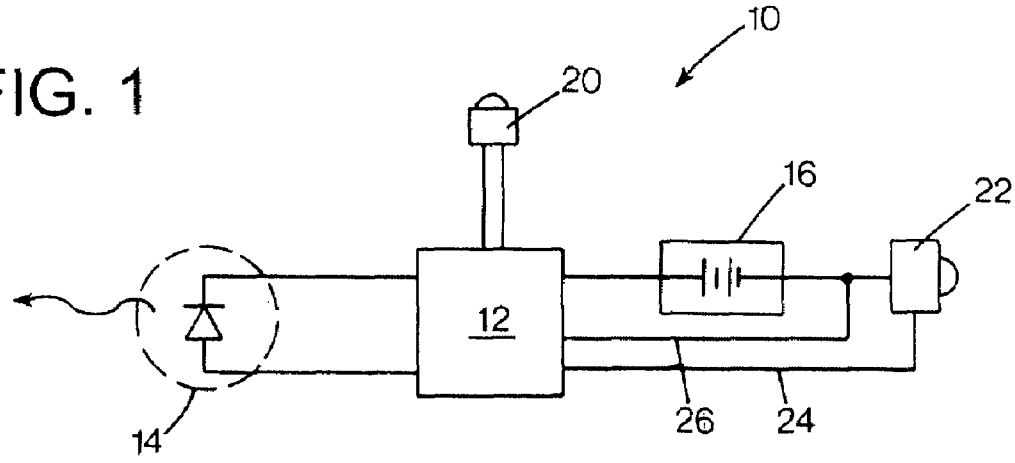
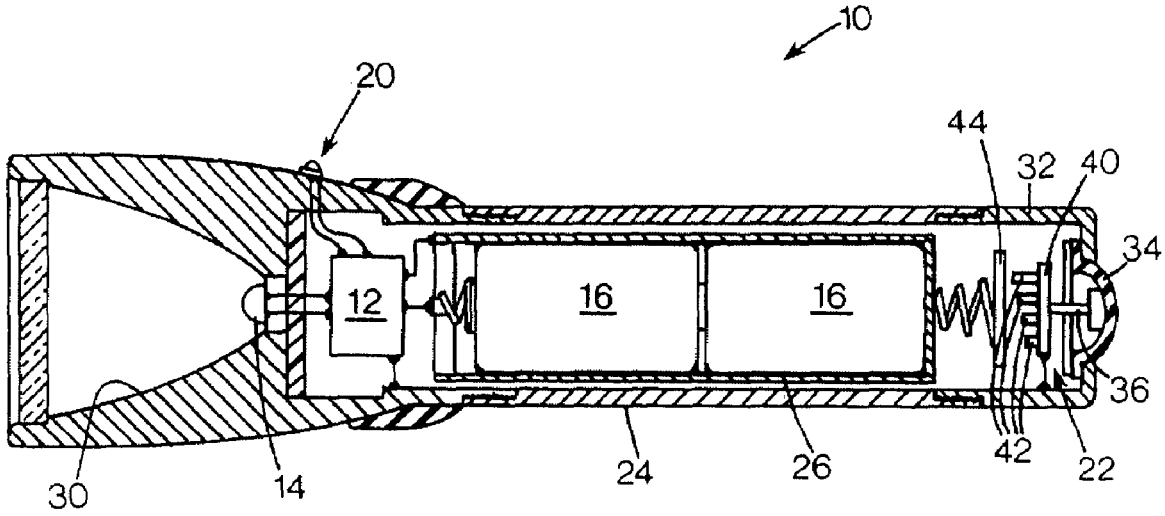
FIG. 2

FIG. 3
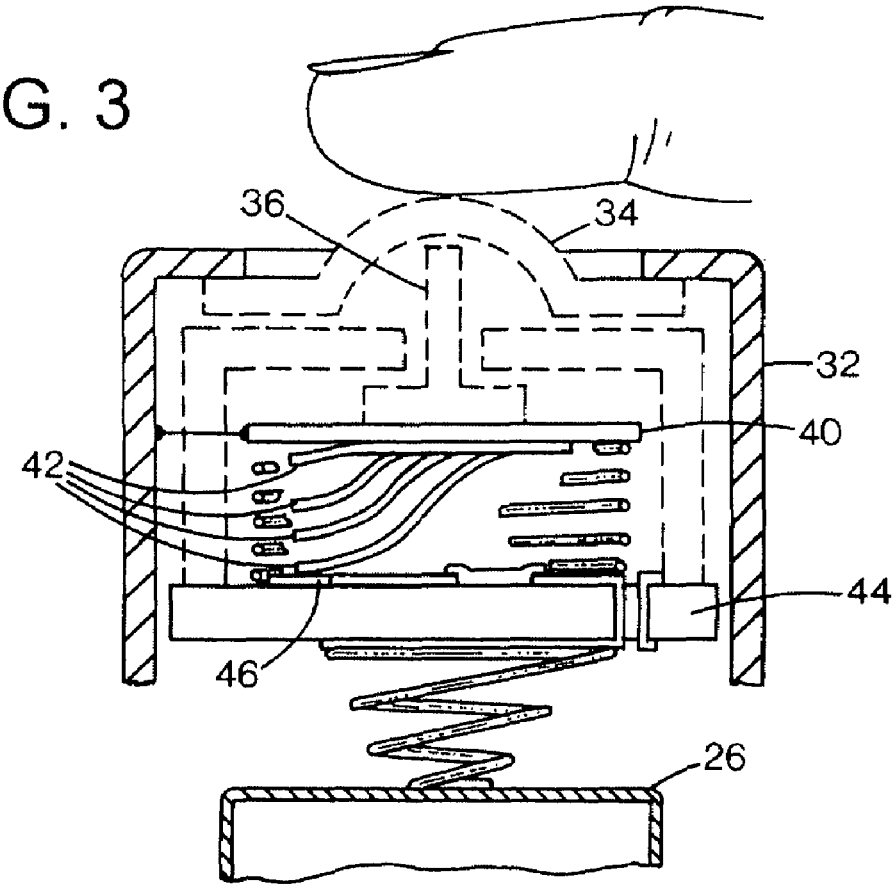
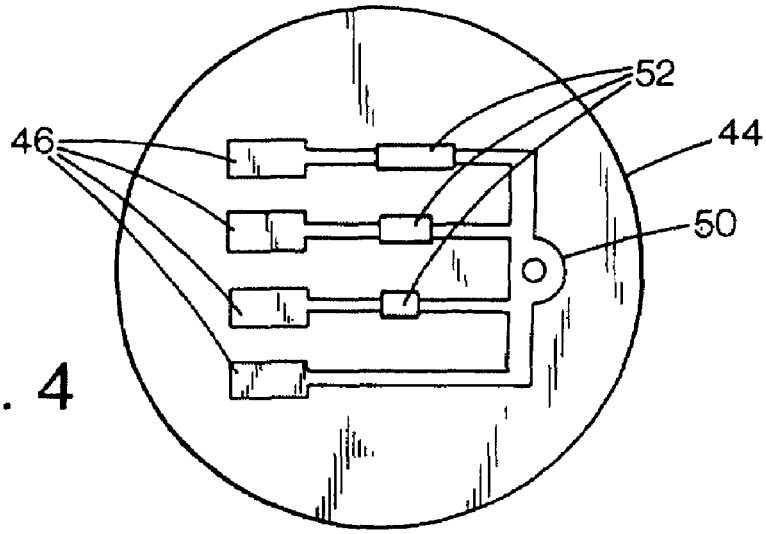
FIG. 4

FIG. 5
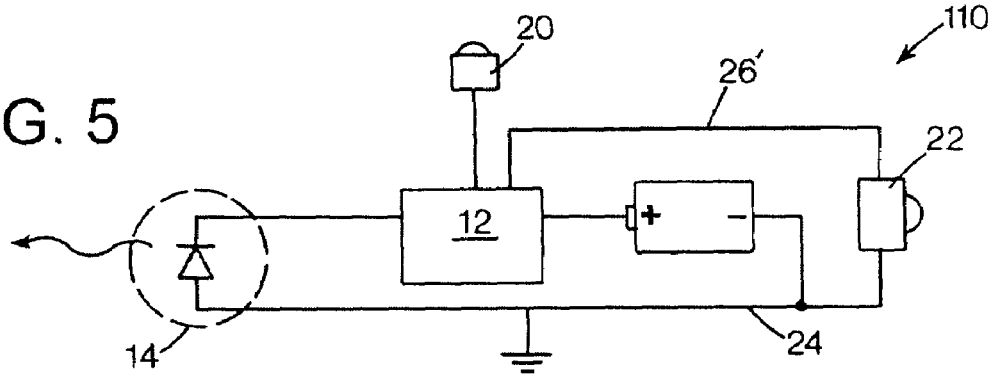
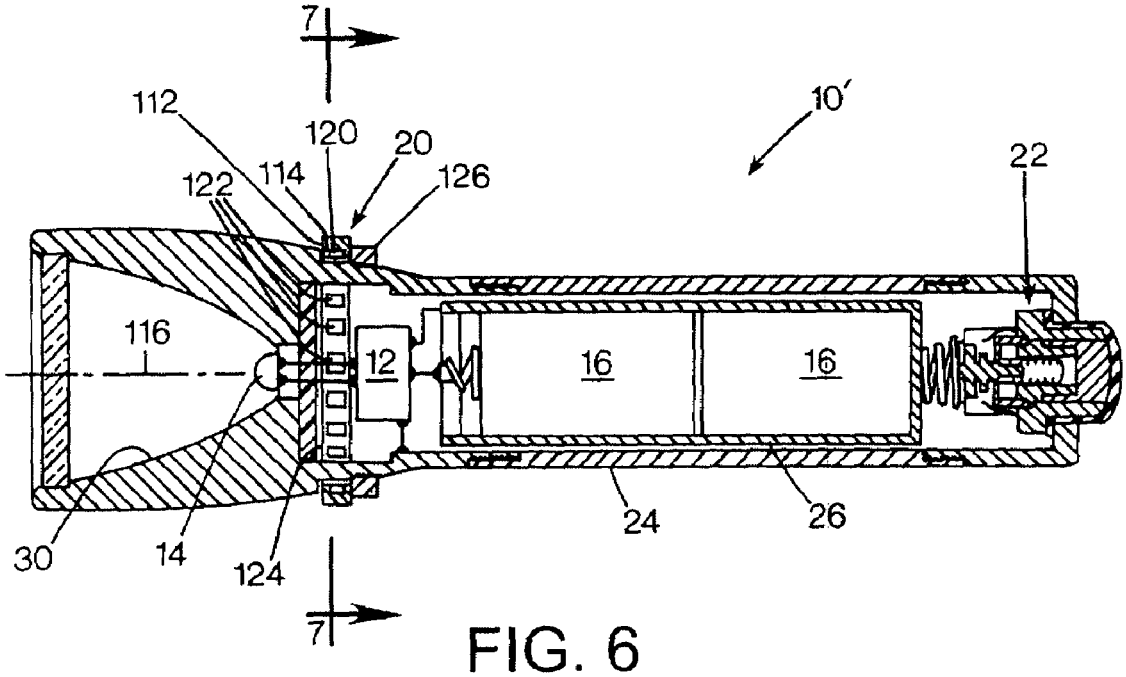
FIG. 6

FLASHLIGHT WITH SELECTABLE OUTPUT LEVEL SWITCHING

This patent application is a continuation patent application of U.S. patent application Ser. No. 10/732,883 filed Dec. 9, 2003, now issued as U.S. Pat. No. 7,220,016.

FIELD OF THE INVENTION

This invention relates to flashlights, and more particularly to switches for controlling flashlight output.

BACKGROUND OF THE INVENTION

Flashlights are conveniently sized battery powered portable light sources, which provide the user with a source of illumination. Said illumination could be white light or light of a specific color, or even light outside the visible range of wavelengths, such as ultraviolet or infrared radiation. The "color" or wavelength of the light will depend on the nature of the light source or light sources used in the flashlight. These would typically be either tungsten lamps, ARC lamps, light emitting diodes (LEDs), lasers, or any other emitter.

Because of the general nature of flashlights and their wide range of applications, it is very desirable for a flashlight to be able to emit, at the user's direction, different levels of light output, and/or different colors or wavelengths of light. This can be accomplished using multiple light sources or a single light source, which can be adjusted to provide different levels of light output.

The principal light source used in flashlights is the tungsten filament lamp, as alternatives suffered inadequate illumination, or excessive battery consumption. Tungsten filament lamps, however, cannot be effectively used as a variable output light source because they must be operated close to their design point (current & voltage) if they are to retain their efficiency in converting electrical energy to light. Generally speaking, the same thing can also be said about ARC lamps. Thus, if one wanted two significantly different light outputs from the same flashlight, this would require the use of two different lamps. Examples of such prior art systems are described in Matthews U.S. Pat. Nos. 5,629,105 and 6,386,730, the former teaching the use of a second lamp protruding through the reflector at a point offset to the side of the main lamp which is located at the focal point of the (parabolic) reflector, and the latter teaching the use of two lamps each with its own reflector, the reflectors merged together in a manner such that the light from each lamp interacts only with its own reflector.

In such existing systems, the switching system consists of mechanical contact arrangement where the physical axial displacement of a switch system element (either by direct finger or thumb pressure or by rotation of a tail cap or head of the flashlight) causes first ene lamp to be connected to the battery, and additional applied pressure or flashlight element rotation causes the second lamp to be connected to the battery. In some cases the design is such that the first lamp is disconnected when the second lamp is connected to the battery. In other cases, the first lamp remains connected when the second lamp is connected.

In practice, such dual- or multi-source flashlights typically have a pressure switch located on the opposite end of the flashlight from the light source. This switch system, or tail cap, may be rotated through a range of angular positions, each providing a different response to application of a button on the pressure switch. Rotation of the switch on the helical threads connecting it to the flashlight body generates axial movement to move contacts toward or apart from each other. In a first position, the switch contacts are farthest apart, so that full pressure of the button has no effect. This is the "lockout" position. By rotating the switch to the second position, fully pressing the button connects the first lamp to the battery, but not the second (and usually brighter) lamp, which is controlled by more widely spaced contacts that remain locked out. In the third position, which is the position most normally used, moderate pressure on the button first connects the first lamp to the battery; greater pressure, including a "bottoming out" condition then connects the second lamp to the battery. In a fourth rotational position, the first lamp remains on when the button is not pressed and the second lamp is connected in response to additional pressure on the button or to additional rotation of the tail cap. In a fifth rotational position both lamps are connected without the application of any pressure on the button While effective, such dual-source lights have several limitations. First, they require the user either to maintain button pressure throughout illumination, or to rotate a switch between operating modes. This requires either continuous use of one hand, or the occasional use of both hands (to rotate the switch), either of which may be disadvantageous for critical military and law enforcement applications.

When set to certain switch modes existing lights do not enable rapid illumination for emergencies. When in the lockout mode or the second mode noted above, maximum pressure will not illuminate the brighter lamp. Changing modes takes time, and requires two hands, which may be disadvantageous in an emergency.

Existing lights have limited choice of light levels. Many tasks require different illumination levels. The moderate level of illumination provided by the first lamp (LED) for many tasks such as camping and ordinary trail navigation may be much brighter than would be desired for map reading in critical military situations. Other applications may require still different moderate lights levels when the full brightness (and shorter run time) of an incandescent lamp is not suitable. Moreover, there is a substantial range of possibly desired brightness levels between the maximum of the first lamp and the full brightness of the second lamp that are not obtainable.

It should be noted that the term "lamp" is used in its most general meaning, namely that of any light source (which could be a tungsten filament lamp, an LED, or an ARC Lamp) of any wavelength.

SUMMARY OF THE INVENTION

The present invention overcomes the limitations of the prior art by providing a flashlight having a lamp, a power source, two switches, and a controller connected to the switches. The first switch controls delivery of power to the lamp, and the second switch selects a dimmed brightness level. The first switch may invoke the dimmed level, or a maximum brightness level. The second switch may be a ring rotatable about the axis the flashlight, and either rotatable through a wide range of positions, with sensor circuitry to detect the absolute position, or having a limited range of rotation, with dimmed level selection provided by a duration of momentary rotation in either direction. The second switch may be positioned outside a leak resistant housing, and may include a magnet detectable by magnetic field sensors within the chamber.

BRIEF DESCRIPTION OF THE DRAWINGS

FIG. 1 is a simplified block diagram of a flashlight according to a preferred embodiment of the invention.

FIG. 2 is a sectional view of the flashlight of FIG. 1.

FIG. 3 is an enlarged sectional side view of the switch assembly of the flashlight of FIG. 1.

FIG. 4 is an enlarged plan view of a switch assembly component of the flashlight of FIG. 1.

FIG. 5 is a simplified block diagram of a flashlight according to an alternative embodiment of the invention.

FIG. 6 is a sectional view of a flashlight according to an alternative embodiment of the invention.

DETAILED DESCRIPTION OF A PREFERRED EMBODIMENT

Figure 8:
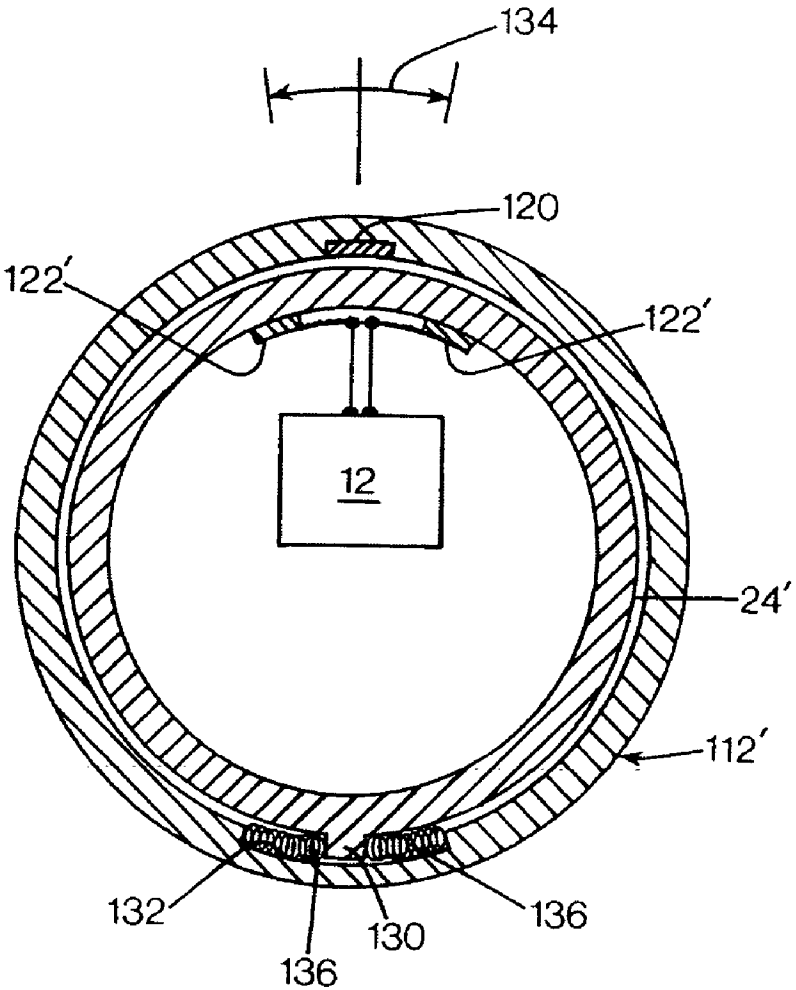
FIG. 8 is an axial sectional view of the dimmer switch mechanism of a further alternative embodiment of the invention.

FIG. 1 shows a schematic drawing of a flashlight 10 according to a preferred embodiment of the invention. The flashlight includes a micro-processor control circuit 12 that is directly connected to a lamp 14, battery 16, dimmed level control selector 20, and operation switch 22.

The lamp 14 is preferably a light-emitting diode (LED), and may be a single lamp that operates efficiently over a wide range of input power to produce a wide range of possible light outputs. In alternative embodiments, there may be multiple light sources, either interconnected to provide a single, switchable (and dimmable) array, with all sources operating in the same manner. In other alternatives, there may be separate lamps or independently controllable lamp elements, so that color hue changes may be obtained by operating different color components in different combinations, or so that dimming control may be obtained by illuminating a different number of the components. The lamp may be an alternative light source, such as a tungsten halogen lamp or any other light source, although LED lamps are believed best suited to presently provide efficiency over a wide range of powers and brightness.

The dimmed level selector 20 may be of any type to provide the operator with the means to select a "dim" brightness level at any intermediate level within the range of the lamp's capability. The dimmed level selector is shown as connected directly to the controller 12, although in alternative embodiments the dimmed level selector may communicate with the controller by other means, including magnetic or radio frequency means. For instance, a rotatable ring may have one or more magnets, and the interior of the flashlight may contain a hall effect sensor connected to the controller to sense position or movement of the ring.

The dimmed level selector may have a selector element such as a dial or slider that establishes a dimmed level based on its position. Alternatively, the selector may establish a dimmed level by responding to the operator's duration (or magnitude) of pressure on a switch, such as by gradually rising in brightness in response to actuation until the selector is released. A dimmed level may be set by numerous alternative means, including by operation of the primary control switch 22, such as by its rotational position, by a series or sequence of impulses, or by any other means.

The flashlight 10 includes a conductive housing that is illustrated schematically in FIG. 1 by a ground bus line 24 extending between a battery electrode and switch lead, and the controller 12. As will be discussed below, the housing is a cylindrical tube defining a bore closely receiving one or more cylindrical batteries 16. Thus, it provides a single electrical path from the switch 22 at the rear end of the flashlight, and the controller 12 at the front end.

A second electrical path is provided over the length of the flashlight by the conductive sleeve element 26 shown schematically here, and detailed below. The sleeve is electrically isolated from the housing, and connects at its closed rear end to the rear of the battery 16 and to a contact from the switch 22, and at its open front edge to the lamp 14 and to the controller 12. The sleeve may be replaced in alternative embodiments by a single conductor wire or circuit element such as a flex circuit to provide the same function. Other alternatives include a conductive trace applied to the interior of the housing (isolated therefrom by an insulating film layer) and connected at each end to the appropriate components. The batteries themselves provide a third electrical path.

The second path provided by the sleeve allows the switch to connect with the controller over two paths, so that the controller may detect a resistance presented by the switch to determine its state, as will be discussed below. The second path further ensures that the switch is not serially connected in the loop with the primary current flow from the battery to the lamp, avoiding parasitic losses due to switch resistance.

FIG. 2 shows the physical structure of the preferred embodiment, with a lens 30 forward of the lamp 14. The housing is has several essentially cylindrical portions defining a chamber for containing the lens, lamp, controller 12, batteries, and switch 22. The dimmer level control 20 is shown in simplified form, and may take any form including a ring rotatable about the housing. The switch (shown in simplified form) is contained within a tail cap 32 having an elastomeric flexible dome 34 covering a switch actuator 36. The switch has a movable portion 40 having several contacts 42 each connected to the housing ground. The movable portion reciprocates axially with respect to a fixed switch portion 44 connected to the conductive sleeve 26.

As shown in FIG. 3, the contacts 42 of the movable portion 40 are leaf springs, each extending a different distance from a base panel that is connected to the housing ground. The switch show in FIGS. 2 and 3 is simplified for clarity of the principles of its operation. The actual switch of the preferred embodiment is configured like existing such switches that allow a bi-level operation. Such switches have the contacts arranged in arcs or annuluses to allow the switch to function when the tail cap is rotated through a range of positions. The preferred embodiment would have its contacts configured as such, although this would unduly complicate the illustrations, which are shown in schematic form.

All the leaf spring contacts are connected to each other. As the switch is depressed over its range of axial travel, the contacts contact the fixed element 44 in sequence. As shown in FIG. 4, the fixed element includes an array of pads 46, each positioned to be contacted by a respective end of a leaf spring contact 42. The pads are all connected to a node 50 that connects via a plated through-hole or other means to the opposite side of the element, which thereby connects to the sleeve 26. Each pad 46 connects to the node 50 with a different intervening resistance. Several resistors 52 are provided to intervene between the various pads and the node.

Before the switch button is depressed, the resistance between the fixed portion (and thereby the controller's connection to the sleeve) and the movable portion (and thereby the controller's connection to the housing ground) is infinite. When the button is slightly depressed, a first leaf spring contact makes contact with a pad associated with a resistor. The controller may thus determine by this resistance across these lines that the button has been pressed to an intermediate position. In the preferred embodiment, the controller then operates the lamp at the pre-selected dimmed illumination level.

When the button is further depressed, another leaf spring contacts a pad. In the simplest case, the switch has only two contacts (not the four illustrated), and the second contact would contact a pad having no resistor. This reflects a condition when the switch is fully depressed, and would cause the controller to provide full brightness illumination. In the more complex embodiment illustrated, there are five button states (including the released condition) determinable by the controller, so that various brightness levels or preselected dimmed or hue outputs might be provided based on the switch condition. The preferred embodiment requires at least two different contacts that make contact at different depression amounts of the button, and are connected to at least one resistor to provide a different output resistance depending on whether one, both, or neither are making contact. In the simple case, one extending spring contact may protrude, with the moving element panel 44 making direct contact in the fully actuated position.

By having an electronic controller connected to the switch, additional switching and control capabilities may be provided that are not provided by a conventional switch in line with the power loop. The illumination of the lamp need not correspond to the position of the switch. This enables a "click-on, click-off" switch mode in which a momentary actuation of the switch causes sustained illumination, and a second momentary actuation ceases illumination. This function is provided in the absence of a conventional mechanical switch that switches between open and closed contact positions using springs and ratcheting mechanisms, in the manner of a ball-point pen or other conventional on-off flashlight switches.

By electronic control of switching operations, significant additional capabilities are made available. The controller may detect the duration of pressure on the button, the magnitude of pressure (for embodiments with multiple leaf springs for at least one intermediate actuated position), and the number and pattern of actuations (enabling distinguishing of commands in the manner of a single or multiple click computer mouse.)

In the preferred embodiment, the tail cap 32 may be unscrewed from the housing a sufficient amount to prevent any switch contacts from making contact even when the button is fully pressed, providing a lockout position for storage to prevent inadvertent discharge of batteries or unwanted illumination during critical operations.

For normal operation, the tail cap is screwed tightly to the scope body to an "operational condition." This differs from conventional flashlights that require the tail cap to be in an intermediate rotational position for selective operation (full screw-down providing constant-on operation in such lights.) This reduces potential operator error, and avoids the need for testing operational condition to ensure proper rotational position in advance of a critical operation, or after replacement of batteries.

When in the operational condition, displacement of the button to a first intermediate position (or intermediate pressure, for strain gauge buttons) causes the controller to provide power to the lamp for illumination at a pre-selected dimmed level, but only while the button is displaced. This provides momentary illumination, or a "dead man's" capability, so that the light turns off when pressure is ceased.

Displacement to a second intermediate position (such as when a second leaf spring makes contact in the switch, so that the controller detects a different resistance level) causes the controller to operate the lamp at the same pre-selected dimmed level, but with sustained operation upon release of the button. The switch may include a mechanical detent mechanism to provide tactile feedback to the operator to indicate that sustained illumination will be provided, or the rubber boot on the tail cap button may be designed with an over-center operation characteristic that provides a distinctive tactile feel when pressure beyond the required level to reach the second intermediate position is provided. In alternative embodiments, feedback devices may include electronic transducers in the flashlight connected to the controller, such as an audio annunciator that provides a "click" sound, or tactile transducers such as piezoelectric devices that provide a tactile response.

When illuminated at the preselected dimmed level, any pressure of the button less than the second intermediate position has no effect, while pressure beyond the threshold that led to sustained illumination and release beyond the first intermediate level will cease illumination.

When in the off condition, or when illuminated at the preselected dimmed level, displacement of the switch beyond the second intermediate level to a third or maximum level causes the controller to provide maximum illumination in a "panic" mode. In the preferred embodiment, full pressure on the switch generally causes sustained illumination at the maximum illumination level. To avoid unintended max illumination when a user intending to "click on" at the preselected dimmed level inadvertently presses momentarily with excessive force to the third level, the controller is programmed to provide sustained max illumination only when the contact at the third level is made for more than a brief pre-selected duration. In such an embodiment, the momentary click by a user to invoke the pre-set dimmed level may result in a momentary flash at the max brightness level, but this ensures that users requiring max brightness receive immediate illumination. In an alternative embodiment where immediate max illumination is not critical, the controller may be programmed to delay max illumination until after the button has been depressed more than the momentary threshold, avoiding the max flask when intermediate lighting is desired. In such an embodiment, maximum output is slightly delayed to ensure at least slightly sustained duration of pressure more than the fraction of a second that would correspond to accidental excess pressure.

From the maximum illumination condition, pressure on the switch beyond the third displacement amount and release of pressure will cease illumination. The controller may be programmed to return from the max illumination to the preselected dimmed level based on whether the light was operating in the preselected level when the max illumination was initiated. The controller may alternatively be programmed to select an illumination condition upon cessation of max illumination based on the degree of switch actuation, such as by turning off after pressure to (and release from) the third level, and by switching to the preselected level after pressure to (and release from) the second level.

In alternative embodiments, the capability to detect switch application duration enables significant flexibility of function. For instance, the max brightness operation may be established as either sustained or momentary based on duration of application beyond the first brief time threshold set to avoid intended max illumination as discussed above. For switch pressure sustained longer than a second threshold greater than the first, the controller provides momentary max illumination only during such pressure. For pressure more than the first duration but less than the second (such as a deliberate but brief application) the action is read by the controller as a "click on" command.

The programmability and flexibility of the switch control provides further advantages in alternative embodiments. Programming may be fixed, or customized based on institutional purchaser requirements, or programmed on an individual basis by each operator. Some applications will prefer programming that avoids accidental max illumination (such as for infantry troops operating at night), while other applications will prefer ready access to max illumination without delay or difficulty (such as for police work.)

The programmable capability of the controller with the electronic switch will provide the user (or a service agency) the capability to re-program the operating characteristics of the device. For instance, where a second dim-level control switch is not desired, the user may invoke a programming mode by a selected sequence of switch actuations. This may be a sequence of pressures to different degrees, a sequence of a number of clicks, or a sequence of clicks of different durations, such as Morse code. Once in a selected programming mode, pressure on the switch may cause the light level to ramp up gradually, so that the user sets the preselected dimmed level by releasing the switch when the dimmed level is desired. Such a mode might be invoked by a simple double click of the switch.

For a flashlight having more than one different light source, such as having multiple colors, the user may program the color (or invisible wavelength) to be output at different modes. This may include selecting hue based on which of several different color lamps (such as RGB LEDs) are illuminated, and in what relative brightnesses. The ability to record and store sequences of different durations also permits the storage of messages (such as entered by Morse code) and subsequent transmission in a regulated format that is readily receivable by other electronic devices. With the fast response time of LED lamps relative to incandescent, such messages may be "hidden" during flashlight operation (in visible or infrared wavelengths) as brief, possibly imperceptible variations of the output level.

The controller may be of any conventional type, programmed and programmable for the various functions above, the circuitry includes a power switching device such as a FET that operates to provide a selected power level to the lamp(s) based on the controller input.

FIG. 5 shows an alternative circuit block diagram of a flashlight 110 having the same capabilities at that illustrated in FIG. 1, but with the sleeve (or alternate second conductive path) 26' being connected only between the switch and the controller, so that the battery power loop passes through the housing ground 24. This may be suitable for applications in which the second conductive path 26' has a high resistance, or low current carrying capability.

While the above is discussed in terms of preferred and alternative embodiments, the invention is not intended to be so limited. For instance, many of the above functions and features of a programmable controller may be provided my other means, and the interface between the switch (which may be located at any position) and the controller need not be hard-wired, but may include data transmitted by radio frequencies emitted by the switch and received by the controller. Alternatively, communication may be provided by optical means, such as by an infrared emitter on the switch and a corresponding detector associated with the controller. Such optical communication may be made by line of sight in a passage adjacent to the batteries within the tube, through an optical conduit such as a fiber, or through a housing member having optically transmissive qualities.

Alternative Embodiment

FIG. 6 shows a flashlight 10' that is essentially the same as that shown in FIG. 1, except that it has a dimmer control 20' in the form of an annular ring 112 that is received in a channel 114 defined about the periphery of the flashlight's housing 24 at the forward portion that houses the lamp 14. The ring and channel are oriented in a plane perpendicular to the flashlight housing and optical axis 116, and are concentric with the cylindrical housing portion. The ring includes an embedded magnet 120 facing toward the center of the ring. The flashlight includes a plurality of Hall effect magnetic field sensors 122 that operate to detect whether or not the magnet is adjacently positioned. The sensors are connected to the control circuit 12, which receives a signal to determine the angular position of the ring at any time.

Figure 7:
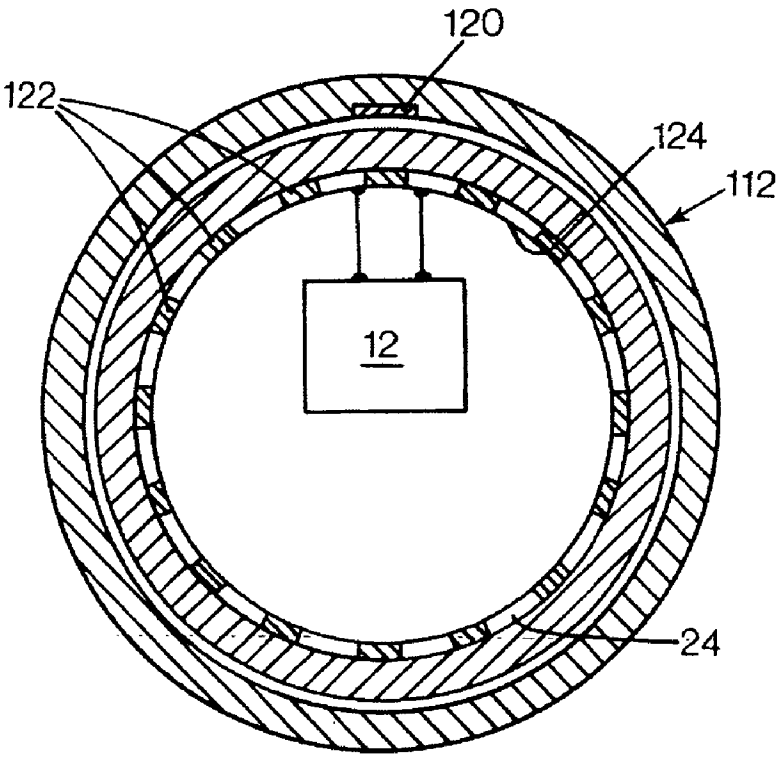
FIG. 7 is an axial sectional view of the dimmer switch mechanism of the embodiment of FIG. 6 taken along line 7-7.

The sensors 122 may be embedded in the housing, such as embodiments in which the housing is molded plastic; in the preferred embodiment, the sensors 122 are attached to a flexible circuit element 124 as shown. As shown in FIG. 7, the flex circuit encircles the interior chamber of the housing, against the outer wall adjacent to the channel 114. The circuit includes between 6 and 20 sensors, which are interconnected to the control circuit. (This number may vary beyond this range for other applications. With this arrangement, the control circuit operates to detect the absolute position of the ring.

Referring back to FIG. 6, the housing's forward bezel portion includes a threaded ring 126 that engages threads on the housing to provide one shoulder or wall of the channel, With the threaded ring being separable from the housing, installation and removal of the switch ring 112 is permitted. Although not shown, a friction device such as a rubber O-ring, felt pad, or spring biased detent may be provided to prevent the ring 112 from turning unintentionally, so that a definite amount of torque is required to change the dim level, avoiding inadvertent changes.

The ring 112 serves to allow the user to establish a state for operation of the flashlight, within a range of discrete options corresponding to the number of sensors 122. In the preferred embodiment, the ring establishes a power or dimmed level for the output of the lamp when the tail cap switch is in an intermediate position or has otherwise been operated to indicate a selected intermediate brightness level. The user may rotate the ring in advance of operation, setting the ring to a known number or other indicia printed on the housing and ring. Alternatively, the user may trigger the intermediate dimmed illumination mode by any of the means noted above, and rotate the ring until a satisfactory brightness is achieved.

Figure 10:
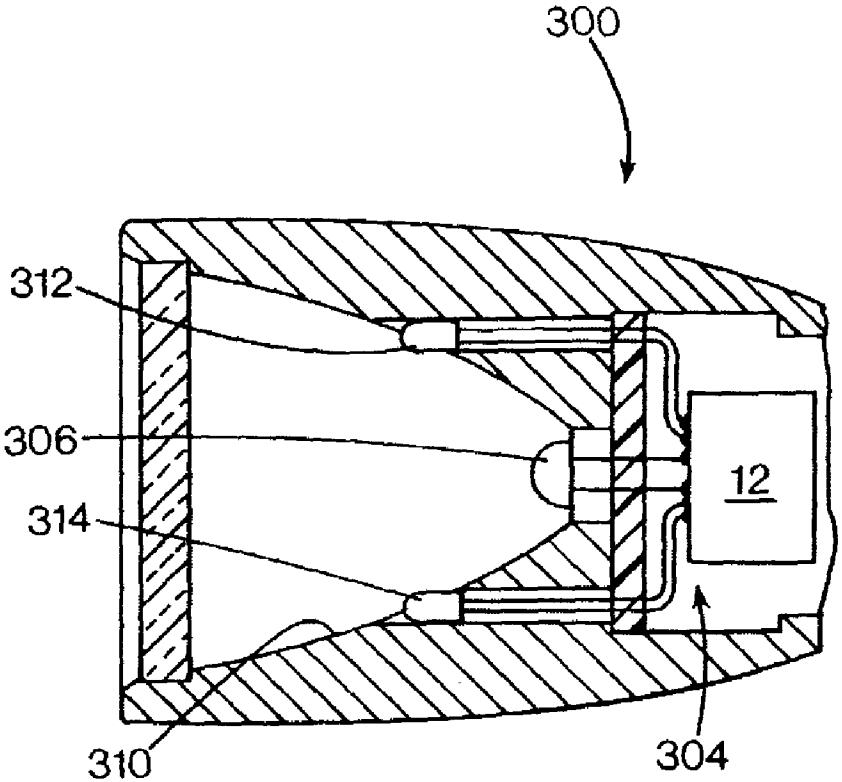
FIGS. 9 and 10 illustrate alternative multiple color lamp alternatives.

In alternative embodiments, the ring may be used to set a second brightness level, such as the maximum level, by rotating to a selected position when the light is illuminated in the maximum mode. The flexibility offered by the control circuit and switches further allows for the setting of any number of brightness levels, which may be achieved by various combinations of inputs related to those noted above with respect to the preferred embodiment, including multiple clicks, and inputs of different durations. The dimmer switch ring may further be used to establish a color output, such as with lamps having variable or different color lamps (as will be illustrated in FIGS. 9 and 10) so that the position of the ring determines which lamp or lamps are illuminated, and in which combination. The light may also be provided with an additional mode that prevents unexpected over-bright operation that would reveal a military position or impair night vision by always reverting to the dimmest level until the switch ring 112 is repositioned to a selected brightness level.

FIG. 8 shows an alternative embodiment dimmed level switch ring 112' in which the dimmed level is based not on the absolute position of the ring, but is adjusted by momentarily imparting slight rotation to the ring 112'. In this embodiment, the housing 24' includes a protruding key 130 in the channel. The ring 112' has a corresponding slot 132 that receives the key. Because the slot is of limited length, the rotation of the ring is limited as the key abuts the ends of the slot at the extremes of travel. This limits angular displacement as indicated by angle 134. The ring is spring biased to a neutral position, as schematically indicated by springs 136. The ring includes a magnet 120, which activates Hall effect sensors 122' that are positioned for activation at the respective limits of rotation. Thus, the controller can detect three different states: first, when the ring is released and at the neutral position, providing no response from either sensor, or when either sensor is triggered by full rotation of the ring to a respective extreme direction.

The FIG. 8 embodiment operates by the control circuit 12 maintaining a selected dimmed level state in memory, and incrementing that state upward or downward by a degree based on the duration the ring is held at a respective limit position. As with the FIG. 7 embodiment, this may be done while the light is illuminated, but may alternatively be done while the light is off, such as by using indicator lights or a display (not shown) to indicate the selected dimmed brightness level. The level may be set by a series of brief impulses in either direction, each incrementing the dimmed level by a nominal amount. This alternative interface may be used to achieve all of the functions as with the FIG. 7 embodiment, including color selection and entry of data and programming codes.

Figure 9:
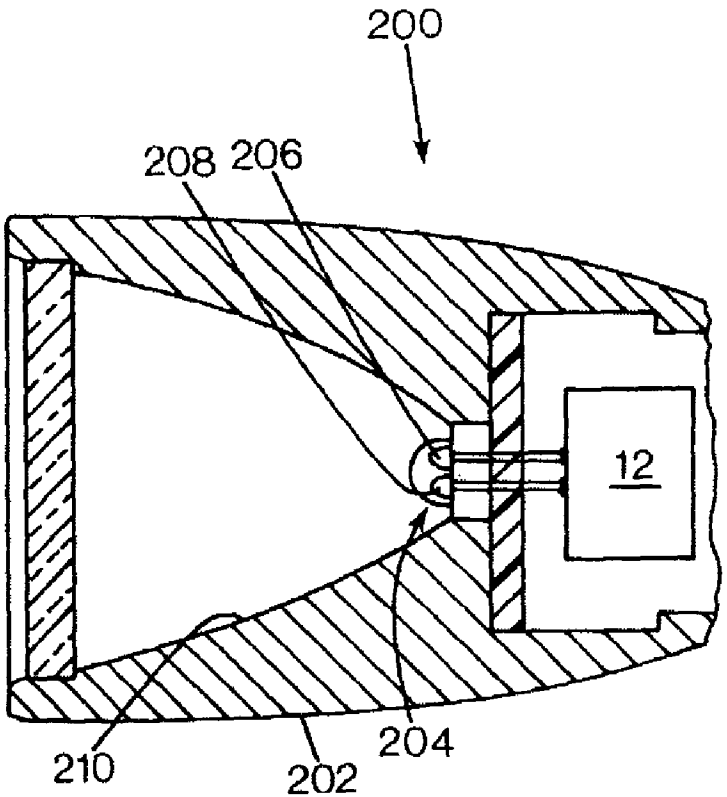

FIG. 9 shows a flashlight 200 having an alternative lamp arrangement for multiple color operation. The flashlight has a housing 202 containing a lamp assembly 204 having more than one different color LED 206, 208 at or near the focus of a primary lens 210. This may include more than two LEDs, to provide a full spectrum of color, such as by providing red, blue, and green LEDs. An infrared or other non-visible emitter may also be included. The FIG. 10 embodiment shows a further alternative light 300 having a housing 302 containing a lamp assembly 304 having a first lamp such as a bright white LED 306 at the primary focus of a reflector 310, with separate LED lamps 312, 314 of different colors having integral lenses and penetrating apertures in the housing. This may be useful for the full color spectrum option noted above, as well as other approaches that use the primary source for a bright beam providing maximum brightness, and the other lamps for specialized uses, such as a red LED for night vision preservation. For instance the tail cap switch may provide illumination of a red led with slight pressure, illumination of the main lamp to a dimmed level with greater pressure, and max illumination of the lamp with full pressure.

This disclosure is made in terms or preferred and alternative embodiments, and is not intended to be so limited.

The invention claimed is:

1. A flashlight comprising:

a lamp;

a power storage element;

a first input device;

a second input device;

an electronic controller;

the controller having a first switch input operably connected to the first input device;

the controller having a second switch input connected to the second input device;

the controller being operable in response to operation of the first input device to deliver power to the lamp;

the controller being operable in response to a signal received from the second input device to select an intermediate level within a range of the lamp's capability, such that the second input device determines a brightness of the lamp; and wherein the flashlight is an elongated body defining an axis, and the second input device is a ring rotatable about the axis.

2. The flashlight of claim 1 wherein the first input device includes an on-off switch.

3. The flashlight of claim 1 wherein the first input device is positioned on a tail cap at an end of the elongated body opposite the lamp.

4. The flashlight of claim 1 wherein the first input device includes an actuator button operable in response to pressure in line with the axis of the body.

5. The flashlight of claim 1 wherein the second input device encircles the body.

6. The flashlight of claim 1 wherein the second input device is positioned at an intermediate position along the length of the body.

7. The flashlight of claim 1 wherein the body defines an elongated battery chamber, and the first input device and the controller are at opposed ends of the battery chamber.

8. The flashlight of claim 1 wherein the body defines an elongated battery chamber, and the second input device and the controller are at a common end of the battery chamber.

9. The flashlight of claim 1 wherein the controller is operable to provide sustained illumination of the lamp in response to application of a first force in a first direction to temporarily rotate the second input device from a first position to a second position, and to maintain illumination of the lamp after the second input device rotates back from the second position to the first position in response to cessation of the force.

10. The flashlight of claim 9 wherein the controller is operable while providing sustained illumination after cessation of the force to cease illumination in response to application of a second force in a second direction to temporarily rotate the second input device from the first position to a third position.

* * * * *